US008325958B2

(12) United States Patent
Rass

(10) Patent No.: US 8,325,958 B2
(45) Date of Patent: Dec. 4, 2012

(54) HEARING APPARATUS WITH PRESSURE EQUALIZATION FOR CONVERTERS

(75) Inventor: Uwe Rass, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1154 days.

(21) Appl. No.: 12/221,941

(22) Filed: Aug. 7, 2008

(65) Prior Publication Data

US 2009/0041274 A1 Feb. 12, 2009

Related U.S. Application Data

(60) Provisional application No. 60/955,064, filed on Aug. 10, 2007.

(51) Int. Cl.
*H04R 25/00* (2006.01)

(52) U.S. Cl. ..... 381/322; 381/323; 381/357

(58) Field of Classification Search ..... 381/322–324, 381/357

See application file for complete search history.

(56) References Cited

U.S. PATENT DOCUMENTS

| | | | | |
|---|---|---|---|---|
| 2,405,179 | A | 8/1946 | Black, Jr. et al. | |
| 4,539,440 | A * | 9/1985 | Sciarra | 381/329 |
| 4,763,307 | A | 8/1988 | Massa | |
| 4,839,871 | A | 6/1989 | Massey | |
| 6,359,993 | B2 * | 3/2002 | Brimhall | 381/328 |
| 2004/0258263 | A1 | 12/2004 | Saxton et al. | |
| 2006/0109999 | A1 * | 5/2006 | Van Halteren | 381/369 |
| 2007/0206826 | A1 | 9/2007 | Roehrlein | |
| 2008/0095390 | A1 | 4/2008 | Gebert et al. | |

FOREIGN PATENT DOCUMENTS

| | | | |
|---|---|---|---|
| DE | 102006008044 | B3 | 5/2007 |
| EP | 1915032 | A2 | 4/2008 |

* cited by examiner

*Primary Examiner* — Steven Loke
*Assistant Examiner* — Kimberly M Thomas

(57) ABSTRACT

The components of a hearing apparatus and in particular of a hearing device are to be better protected against environmental influences. A hearing apparatus is thus provided with at least one acoustic converter, e.g. receiver, in a converter housing for receiving or outputting a sound, with a sound opening in the converter housing, through which or by which a sound is received or output respectively, being sealed with an airtight membrane. A pressure equalization facility is connected to the converter housing or is integrated onto the converter housing, so that the pressures on both sides of the membrane can be equalized.

8 Claims, 2 Drawing Sheets

HEARING APPARATUS WITH PRESSURE EQUALIZATION FOR CONVERTERS

CROSS REFERENCE TO RELATED APPLICATIONS

The present application claims the benefit of a provisional patent application filed on Aug. 10, 2007, and assigned application No. 60/955,064, which is incorporated by reference herein in its entirety.

FIELD OF THE INVENTION

The present invention relates to a hearing apparatus with pressure equalization for converters. The term hearing apparatus is understood here to mean in particular a hearing device, but also any other sound-outputting device which can be worn on the ear, like for instance a headset, earphones or suchlike.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with an external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

Hearing devices would have typically not have been able to be sealed hermetically, since the membranes of the microphone and the receiver were pretensioned by the difference of the outer and inner air pressure. The term "membrane" is understood here to mean an electroacoustically active membrane or also the cover membrane for protection against the penetration of fluid and/or particles.

The outer air pressure depends on the height above sea level, on the meteorological conditions and on the temperature, while the pressure on the inside of the membrane would remain the same in the case of a closed converter housing and constant temperature. As a result, a force would be exerted on the membrane, which may also lead to damage to the converter.

The microphone and loudspeaker thus have an air equalization opening, so that both sides of the membrane experience the same pressure. The hearing device housing is connected to the outer region by way of an additional gas-permeable membrane. The disadvantage of this construction is that steam can reach the inner region of the hearing device through the membrane and can thus also reach the converter itself by way of the air equalization opening. If the steam condenses, the sensitive metal parts may corrode.

The patent application DE 10 2006 008 044 B3 discloses a hearing aid device which can be worn in the ear and comprising a ventilation channel. The barometric pressure equalization in a sound channel between a receiver and a cerumen protection facility with a gastight membrane is achieved by a pressure equalization channel, which opens into the sound channel. The pressure equalization channel connects the sound channel to the outer region and/or a ventilation channel.

SUMMARY OF THE INVENTION

The object of the present invention thus consists in better protecting the components of a hearing apparatus against environmental influences.

This object is achieved in accordance with the invention by a hearing apparatus with at least one acoustic converter in a converter housing for receiving or outputting a sound, with a sound opening in the converter housing, through which a sound to be received or output passes, being sealed with an airtight membrane, and with a pressure equalization facility being connected to the converter housing or integrated into the converter housing, so that the pressures on both sides of the membrane can be equalized. The converters together with the pressure equalization facility have a changeable gastight sealed volume here.

The electroacoustic converter of a hearing apparatus can thus advantageously be sealed hermetically. The membrane of the converter, its housing and a changeable (outer) volume namely form a gas-tight sealed region. As a result, this prevents steam in particular from corroding parts of the converter.

The pressure equalization facility can comprise a tubular element for instance, which is connected on the one hand to the converter housing and is on the other hand open, with a liquid, which separates the two ends of the tubular element in an airtight fashion, being freely moveable in the tubular element. The liquid volume which is moveable in a tube or a pipe can easily achieve a change in volume.

Alternatively or in addition, the pressure equalization facility can comprise a bellows, the volume of which changes with the ambient pressure. It may be advantageous, particularly with larger pressure differences, to use a bellows. In the event of changeable dynamics of the pressure changes, it may in some circumstances be favorable to use both a bellows as well as the tubular element with a moveable liquid.

The converter of the hearing apparatus may be a receiver or a microphone. It is advantageous in the case of both components to create a pressure equalization and at the same to provide for a hermetic barrier effect.

With a special embodiment, the hearing apparatus has a microphone and a receiver as acoustic converters in each instance, with the pressure equalization facility connecting the converter housing of both converters. It is naturally also possible to provide a common pressure equalization facility for several microphones. It is thus not necessary to have to provide a separate pressure equalization facility for each individual converter.

According to a further preferred embodiment, the pressure equalization facility has a region which is outwardly sealed in an air-tight fashion, in which at least one electronic component of the hearing apparatus is accommodated. In particular, this at least one electronic component may be an amplifying circuit or a battery. The pressure equalization facility with an outwardly hermetically sealed region is also used here for the function of protecting additional components of the hearing apparatus from environmental influences.

BRIEF DESCRIPTION OF THE DRAWINGS

The present invention is described in more detail with reference to the appended drawings, in which.

DETAILED DESCRIPTION OF THE INVENTION

The exemplary embodiments illustrated in more detail below represent preferred embodiments of the present invention.

Figure 1:
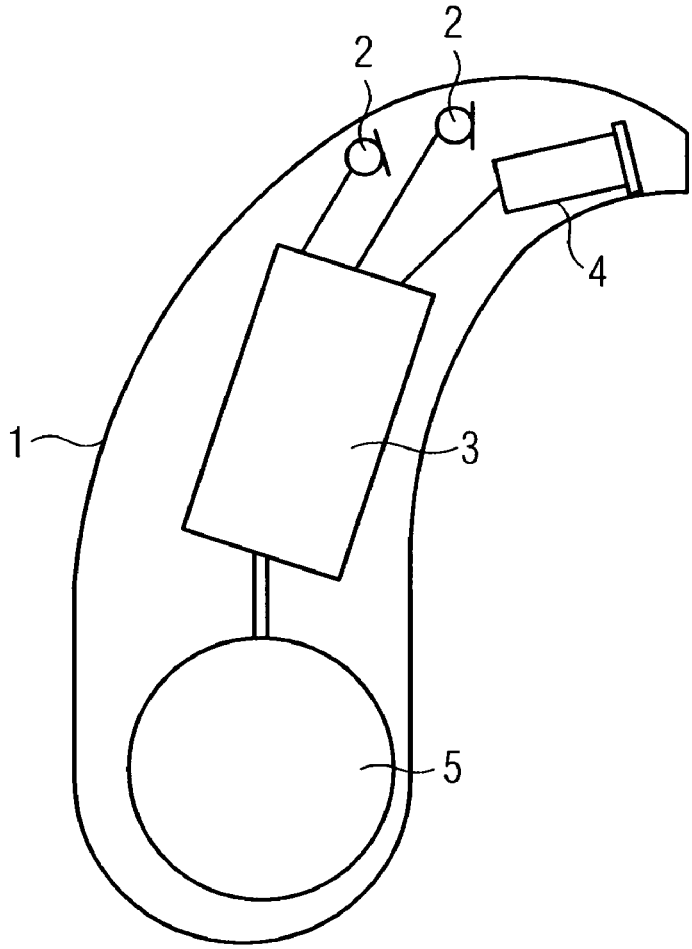
FIG 1 (Prior art)
FIG. 1 shows the basic design of a hearing apparatus according to the prior art.
Figure 2:
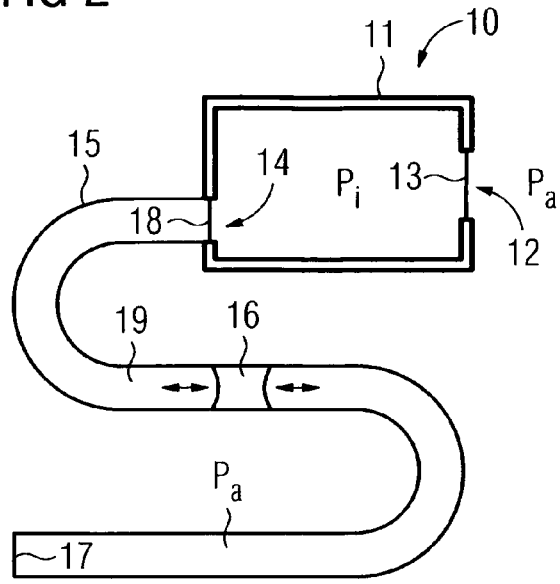
FIG. 2 shows a schematic representation of a converter with a tube element for pressure equalization.

FIG. 2 shows a receiver 10 with a receiver housing 11. The receiver 10 is used as an electroacoustic converter for a hearing apparatus and in particular for a hearing device. The receiver housing 11 has a sound opening 12, which is sealed by a membrane 13 in an air-tight fashion. The membrane 13 is either used only as a cover membrane for protection against contamination or as an electroacoustically active membrane.

The converter housing and/or receiver housing 11 has an additional opening 14, to which a pipe 15 as a tubular element is connected. A liquid stopper 16, which is freely moveable inside the pipe 15, is located in the pipe 15. Gas-permeable membranes 17 and 18, which prevent liquid stoppers 16 from leaving the pipe, are only located at the ends of the pipe 15.

The air volume 19, which is delimited on the one hand by the air-tight membrane 13 in the receiver housing 11 and on the other hand by the liquid stopper 16 in the pipe 15, is variable as a result of the moveability of the stopper 16. The outer or ambient pressure is specified in FIG. 2 with Pa. It prevails not only outside the receiver housing 11, but also in the pipe piece between the liquid stopper 16 (e.g. oil) and the membrane 17, which seals the free end of the pipe 15. The inner pressure $p_i$ prevails inside the receiver housing 11 as well as inside the pipe 15 from the receiver housing 11 to the liquid stopper 16. As the liquid stopper 16 in the pipe 15 is freely moveable, a pressure equalization takes place, so that:

$$p_i = p_a$$

applies.

Figure 3:
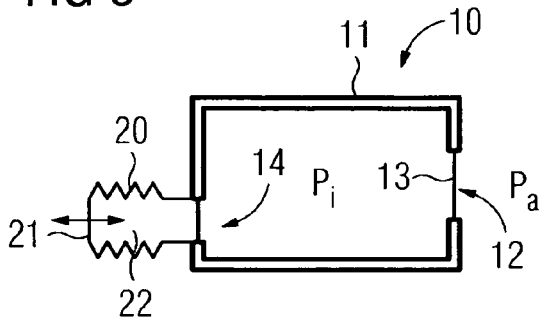
FIG. 3 shows a schematic representation of a converter with bellows for pressure equalization and FIG. 4 shows a schematic representation of a hearing device with several hermetically sealed electronic components.

FIG. 3 shows a further exemplary embodiment of an acoustic converter for an inventive hearing apparatus. The receiver housing 11 is also sealed here by a membrane 13 on the sound opening 12. A bellows 20 is connected to the further opening 14 instead of a pipe. It is sealed except for the opening 14. The base 21 of the bellows 20 is moveable, so that the volume 22, which is sealed by the receiver housing 11 and the bellows 20, is variable. The pressure inside this sealed volume 22 is designated here again with $p_i$, while the outer pressure is identified with $p_a$. The bellows 20 as a pressure equalization facility provides for a pressure equalization to take place and $p_i = p_a$ applies again.

Figure 4:
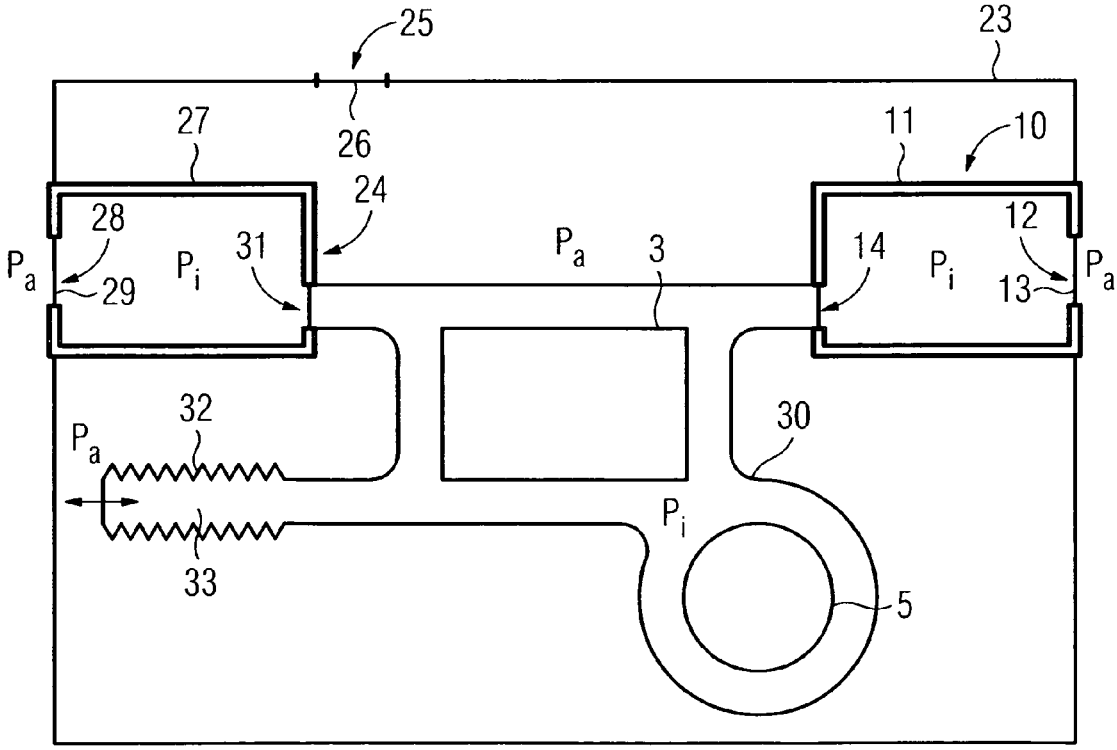

FIG. 4 shows a schematic representation of the most important components of a hearing device within a hearing device housing 23. This hearing device housing is stiff and not elastic. It is thus necessary for the acoustic converter, here the receiver 10 and a microphone 24, for a pressure equalization to take place via an opening 25 in the hearing device housing. This opening 25 is sealed with a gas-permeable membrane 26, so that no contaminations can reach the hearing device. The pressure $p_a$ thus prevails not only outside the hearing device housing 23, but instead also inside it.

The microphone 24 has a microphone housing 27 and is thus positioned with its sound inlet opening 28 on a recess of the hearing device housing 23, such that sound can reach the microphone 24 unobstructed. The sound inlet opening 28 is sealed with a membrane 29, which is in turn acoustically active or only serves as a protective membrane against contaminations. In any case it is airtight. No pressure equalization takes place thereover.

Like with the microphone 24, with the receiver 10 the sound opening 12 also points outwards and is sealed with the membrane 13 like with the examples FIGS. 2 and 3.

A membrane structure 30 is connected here to the pressure equalization opening 14 in the receiver housing 11 of the receiver 10, said membrane structure 30 also involving the battery 5 as well as the signal processing unit 3 and/or the corresponding amplifying chip in its interior. A pressure equalization opening 31 of the microphone 24 as well as a bellows 32 is also connected to the membrane structure 30. The inner regions of the microphone 24 and receiver 10 are thus not only sealed hermetically against environmental influences, but instead also the amplifying chip 3 and the battery 5. An inner pressure $p_i$ also adjusts inside the membrane structure 30. As the inner volume 33 of the membrane structure 30 is again variable by means of the bellows 32, a pressure equalization takes place, so that: $p_i = p_a$. The membranes 29 and 13 are thus also not pretensioned here by different inner and outer pressures.

As the outer surface of the bellows 20, 32 and/or of the liquid stopper 16 are in contact with the outside world in the above examples, it experiences the same pressure as the membranes 13, 29 of the respective converter.

If necessary, the pressure equalization facility can also be realized with pistons which can be moved into one another, if necessary also actively.

In order to estimate the necessary change in volume for the pressure equalization, let it be mentioned here that the air pressure approximately halves at a height of 5000 m by comparison with the pressure at sea level. To be able to equalize this variation, a doubling of the volume of a converter for instance is necessary.

With the exemplary embodiments illustrated above, a pressure equalization is thus possible, without steam or other harmful gasses, e.g. with sweat constituents, reaching the inner region of the converter and/or the sensitive parts of the hearing device. Provided the membranes 13, 29 of the converter are sufficiently stable, a water-tight (protected against immersion) hearing device can also be realized.

The invention claimed is:

1. An acoustic converter adapted to be used in a hearing apparatus comprising:

a converter housing;

a sound opening in the converter housing that is sealed with an airtight membrane; and a pressure equalization unit connected to the converter housing that equalizes a pressure within the converter housing to an ambient pressure, wherein the pressure equalization unit has an outwardly air-tight sealed region.

2. The acoustic converter as claimed in claim 1, wherein the pressure equalization unit is a bellows.

3. The acoustic converter as claimed in claim 2, wherein a volume of the bellows changes with the ambient pressure.

4. The acoustic converter as claimed in claim 1, wherein the acoustic converter comprises a receiver or a microphone.

5. The acoustic converter as claimed in claim 1, wherein the acoustic converter comprises a receiver and a microphone.

6. The acoustic converter as claimed in claim 5, wherein the pressure equalization unit connects a converter housing of the receiver and a converter housing of the microphone.

7. The acoustic converter as claimed in claim 1, wherein an electronic component of the hearing apparatus is accommodated in the air-tight sealed region.

8. The acoustic converter as claimed in claim 7, wherein the electronic component comprises an amplifying circuit or a battery.

* * * * *